United States Patent [19]

Kabasin et al.

[11] Patent Number: 4,901,695

[45] Date of Patent: Feb. 20, 1990

[54] DUAL SLOPE ENGINE DRIVE-BY-WIRE DRIVE CIRCUIT

[75] Inventors: Daniel F. Kabasin, Rochester, N.Y.; Glen C. Hamren, Greentown, Ind.

[73] Assignees: Delco Electronics Corporation, Kokomo, Ind.; General Motors Corporation, Detroit, Mich.

[21] Appl. No.: 260,337

[22] Filed: Oct. 20, 1988

[51] Int. Cl.[4] ..... F02D 9/02; F02D 41/14

[52] U.S. Cl. ..... 123/399

[58] Field of Search ..... 123/361, 399

[56] References Cited

U.S. PATENT DOCUMENTS

| | | | |
|---|---|---|---|
| 4,508,078 | 4/1985 | Takeuchi et al. | 123/399 |
| 4,691,677 | 9/1987 | Hotate et al. | 123/399 |

FOREIGN PATENT DOCUMENTS

| | | | |
|---|---|---|---|
| 3512473 | 10/1985 | Fed. Rep. of Germany | 123/399 |
| 122745 | 7/1984 | Japan | 123/399 |
| 122746 | 7/1984 | Japan | 123/399 |

*Primary Examiner*—Tony M. Argenbright
*Attorney, Agent, or Firm*—Howard N. Conkey

[57] ABSTRACT

A dual slope drive-by-wire device circuit is used for controlling the position of the throttle of an engine. The circuit generates a command such that the response is a low gain for low values of throttle position for providing a desired resolution at low throttle angles such as idle, and a high gain for higher throttle angles, producing a desired range of throttle angle control. The throttle is positioned in response to the command signal.

1 Claim, 2 Drawing Sheets

DUAL SLOPE ENGINE DRIVE-BY-WIRE DRIVE CIRCUIT

BACKGROUND OF THE INVENTION

This invention relates to a circuit for controlling the position of the throttle of an engine and, more particularly, to an electronic drive-by-wire throttle position control circuit for an engine that provides two output resolutions from a single input command signal.

In an electronic drive-by-wire system for an automotive vehicle engine, the motorized throttle must produce the same dynamic range of air flow as the conventional cable drive, while retaining the resolution required for idle speed control previously produced by the idle air control valve. In general, to accurately control throttle at idle, much more resolution is needed than at other throttle positions. If the slope of the throttle angle versus the command voltage is established to obtain the required throttle angle range for the available command voltage range, the resolution for idle speed control may be inadequate. Conversely, if the slope is adjusted to obtain the required resolution for idle speed control, then the range of throttle angle control may not be achievable for the available control voltage.

A problem exists in conventional systems in that the microprocessor signal used to generate the drive signal has a limited bit resolution. For example, where 8-bit resolution (256 bits of information) is sufficient to command the throttle range, much finer resolution such as 10-bit resolution (1024 bits of information or four times the resolution of 8 bits) is required to command the idle speed range. However, the conventional vehicle engine control module has neither a 10-bit digital to analog converter nor a 128 Hertz 10-bit pulse width modulator signal. The conventional vehicle engine control only has an 8 bit 128 Hertz pulse width modulator signal. Consequently, the engine control modules of existing systems do not have the resolution capabilities required for idle speed range.

SUMMARY OF THE INVENTION

The subject invention overcomes the resolution difficulties of prior systems by providing a dual slope action from a single signal. This single input results in two output resolutions available from the drive circuit for positioning the throttle. A single resolution exists between the computer and the drive circuit and two different throttle angle resolutions exist between the drive circuit and the throttle area, one for idle speed conditions and the other for off idle speed conditions. This invention provides for control of the throttle position in any given speed range by generating two output resolutions from a single input command signal.

In general, the subject invention overcomes the resolution difficulties of prior art systems by generating a dual slope throttle position command signal from a single input command signal. In particular, the subject invention provides a throttle positioning system in which the gain of the system at low throttle angles such as idle provides improved resolution, while at higher throttle angles a higher gain is utilized to provide the required throttle angle range.

The purpose of the subject invention is to use a substantial portion of the available command for idle range and apply the remainder of the available command to the off-idle range. In one embodiment of the invention, 50% of the available command is used to supply only 10% of the speed range (idle) while the other 50% supplies the remaining 90% of the speed range (off idle). Consequently, a proportionately large portion of the input command voltage is used to generate a small change in throttle angle at the low end of the speed range while the remaining portion of the input command voltage is used to generate the throttle angle change over the entire rest of the range.

In this invention, in an idle speed range a large voltage change results in a small throttle angle change. This suggests that voltage can be varied to more accurately control the throttle angle. With a single input command voltage to the throttle motor driver, an initially low voltage gain is created resulting in a shallow upwards slope. At some predetermined command voltage representing an off idle command, the shallow upward slope increases to a sharp upward slope, resulting in a dual slope throttle motor driver. This dual slope results in improved resolution of control of the throttle position during idle speed ranges while retaining the overall throttle angle control range.

The foregoing and other objects of this invention may be best understood by reference to the following description of a preferred embodiment and the drawings in which.

DESCRIPTION OF THE PREFERRED EMBODIMENT

Figure 1:
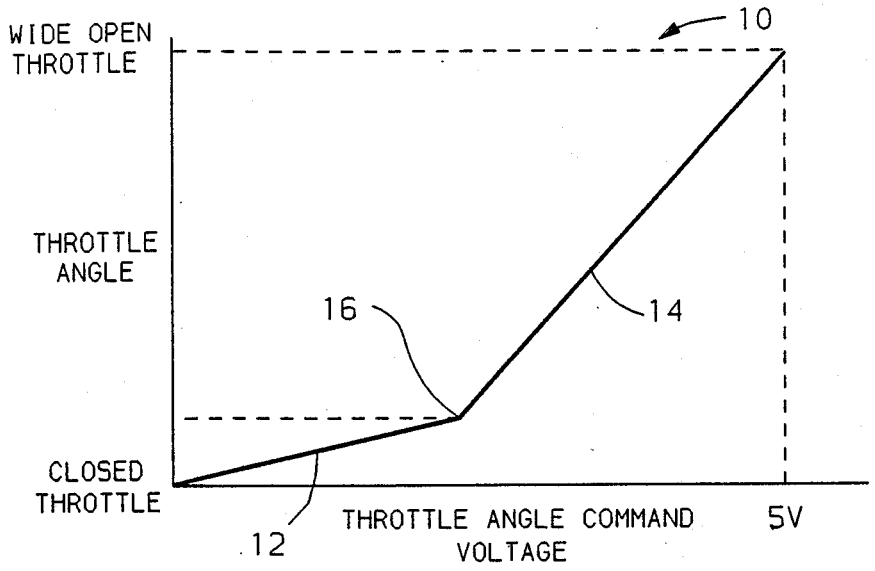
FIG. 1 shows the preferred characteristics of the dual slope drive-by-wire drive circuit by illustrating the relationship between throttle angle and motor voltage.
Figure 2:
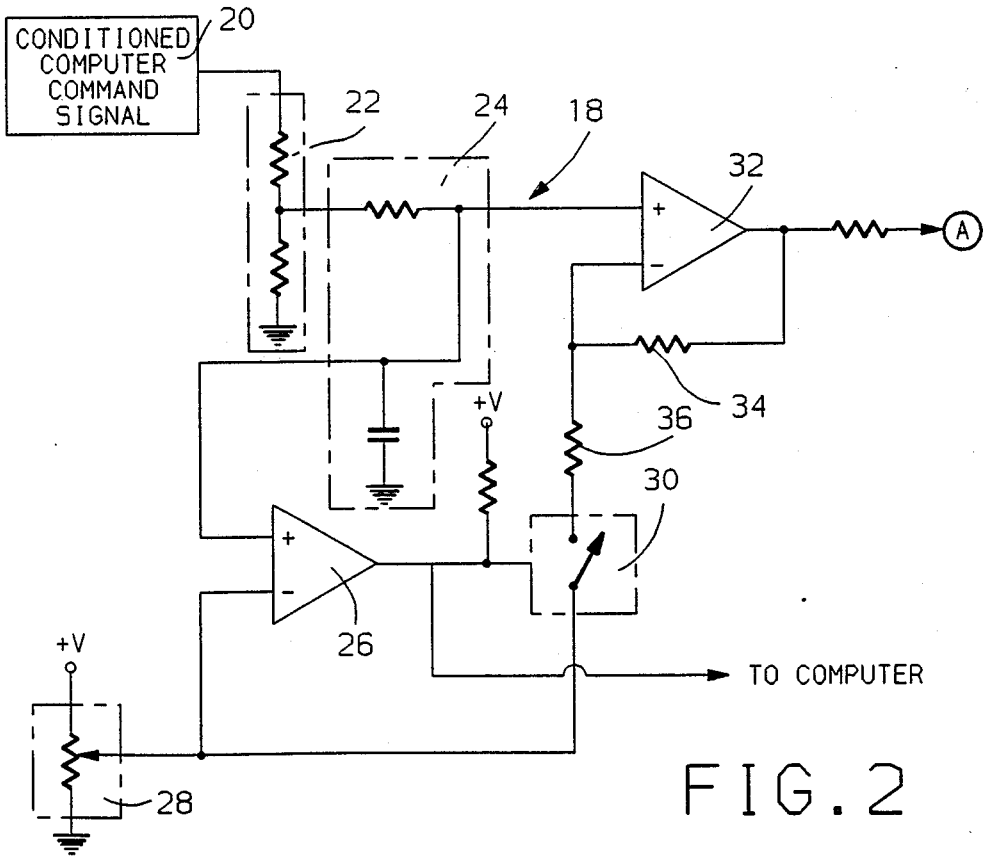
FIG. 2 is a circuit for generating a modified command position which results in the dual slope of FIG. 1.

Referring to the drawings, and more particularly to FIG. 1, reference numeral 10 generally designates a dual slope response of the drive-by-wire drive circuit of FIG. 2. Reference numerals 12 and 14 designate the dual slope result of controlling throttle position with a single input command signal. If slope 12 of the curve were to continue at its shallow upwards sloping rate providing the required throttle angle control resolution for low throttle angles, the throttle angle would never reach a wide open throttle position within the range of the command voltage (5 volts in this example). Consequently, the invention provides for a sudden sharp increase in the upwards slope at a given throttle angle, designated by reference numeral 16, above which less resolution is required for throttle angle control. During slope 14 of the curve, then, the throttle angle achieves a wide open throttle position by the time the command voltage reaches its maximum value.

In one embodiment of this invention, while 8-bit resolution is sufficient to command the throttle range, four times or more resolution such as 10-bit resolution is required to command the idle speed range. In FIG. 1, then, slope 12 of the curve is compressed down to supply the equivalent of 10-bit resolution or better in the idle speed range where much finer resolution is required, while slope 14 illustrates that only the equivalent of 8-bit or less resolution is sufficient for the off idle speed range. Essentially, the subject invention takes some resolution from the off idle speed range where it is not needed and supplies that resolution to the idle speed range where it is needed.

Referring now to FIG. 2, reference numeral 18 generally designates the portion of the drive-by-wire drive circuit capable of accomplishing the dual slope result of FIG. 1. Reference numeral 20 designates a conditioned 8 bit resolution computer command signal generator for throttle position. The output from the vehicle operator is applied to the computer to generate a conditioned computer command signal indicative of the throttle position. The voltage from the conditioned computer command signal generator 20 is applied to a voltage divider 22 which divides down the command signal before being applied to a filter 24.

The output of the filter 24, which represents an attenuation of the computer command, is applied to an amplifier 32. The output of filter 24 also is supplied to the positive terminal of comparator 26, which compares the voltages at its positive and negative terminals to determine if the switch 30 should be open or closed. Switch 30 is a solid state switch biased on (closed) or off (open) by the output of the comparator 26. In a preferred embodiment of this invention, a feedback signal from the comparator 26 relays information to the computer so the computer can determine if the voltage gain has changed. This feature assists in diagnosis of the drive circuit 18.

A potentiometer 28 supplies the negative terminal voltage to the comparator 26. This voltage is equal to the voltage at break point 16 in FIG. 1. As long as the negative terminal voltage of comparator 26 is greater than the positive terminal voltage, the output of comparator 26 will be LOW and the switch 30, controlled by the output of the comparator 26, will be open. When this condition exists, the amplifier 32 with its feedback resistor 34 is configured as a voltage follower. When the positive terminal voltage becomes greater than or equal to the negative terminal voltage, the output of comparator 26 becomes HIGH and switch 30 will close to place resistor 36 and the potentiometer 28 in the amplifier 32 circuit. This condition configures the amplifier 32 so as to increase its gain. It is at this point that the sharper gain 14 of the curve illustrated in FIG. 1 is generated, as will be described.

As indicated, the amplifier 32 has applied to its input terminal the attenuated command voltage. At low computer command signal values corresponding to low throttle angles at which the resulting attenuated command signal is less than the threshold value established by the potentiometer 28, the switch 30 is open as previously described resulting in the amplifier 32 operating as a voltage follower providing the slope 12 of the curve shown in FIG. 1. This slope establishes the required resolution in the control of the throttle angle by the circuit of FIG. 3 at low throttle angles such as encountered at engine idle conditions. When the attenuated command signal exceeds the threshold set by the potentiometer 28, the gain of the amplifier 32 is increased to amplify the attenuated command signal so as to provide the slope 14 of the curve illustrated in FIG. 1. This slope establishes the required range of throttle angle control by the circuit of FIG. 3 at higher throttle angles such as at engine off idle conditions.

Figure 3:
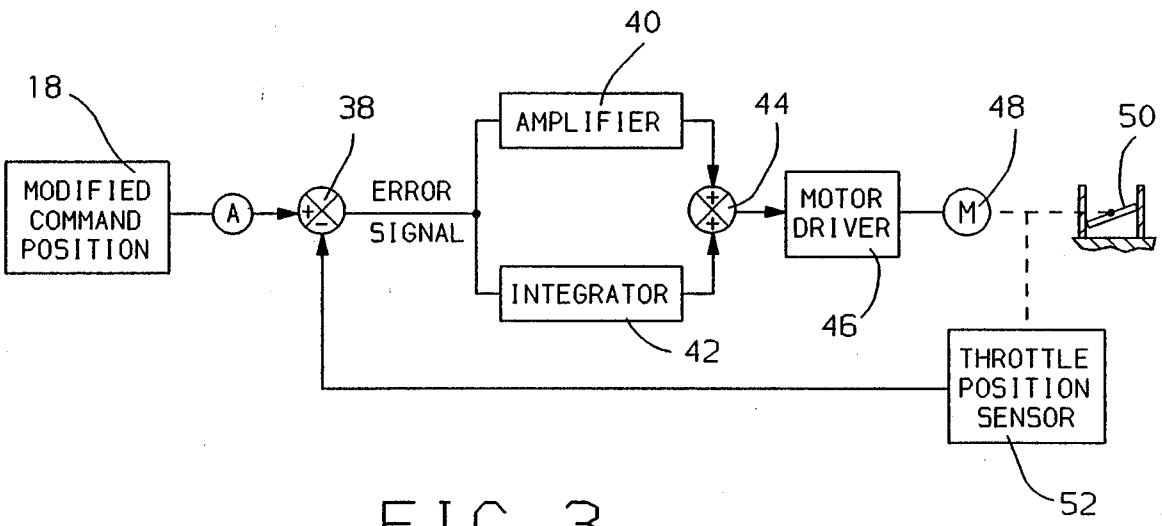
FIG. 3 is a diagram illustrating a motor driver circuit for controlling throttle position.

Referring now to FIG. 3, the modified command position output from amplifier 32 is input to a summing junction 38 of a closed loop throttle angle controller. Summing junction 38 sums the modified command throttle position signal and the actual throttle position signal, derived as will be described, to determine the error between them. The closed loop circuit includes an amplifier 40 responding to the error signal from the summing junction 38 for generating a proportional control term and an integrator 42, responding to the error signal from the summing junction 38, for generating an integral control term.

The sum of the proportional term and the integral term, which is calculated at summing junction 44, is input to a motor driver 46. In the preferred embodiment of this invention, motor driver 46 takes the form of an H-switch comprised of two pairs of solid state switching elements. One pair of switching elements is series-coupled between the vehicle battery and ground through the motor in one direction, while the second pair is series coupled between the battery and ground through the motor in the opposite direction. Current will flow in one or the other direction to motor 48 depending on which pair of switching elements is simultaneously biased conductive, causing the actual throttle position angle to either increase or decrease to approach the command throttle position.

The output shaft of the motor 48 positions the throttle plate 50 whose position is sensed by the throttle position sensor 52, which may simply be a potentiometer. This actual throttle position signal is fed back to summing junction 38 where it is summed with the command throttle position as previously described. Through this closed loop, the throttle 50 is positioned so as to reduce the error from the summing junction 38 to zero, at which time the throttle position is at the commanded position.

The foregoing description of a preferred embodiment for the purpose of illustrating this invention is not to be considered as limiting or restricting the invention since many modifications may be made by the exercise of skill in the art without departing from the scope of the invention.

The embodiments of the invention in which an exclusive property or privilege is claimed are defined as follows:

1. A drive-by-wire system for controlling the position of an internal combustion engine throttle valve member rotatable within a predetermined range, the system comprising:

a digital computer for generating a throttle position command signal having a constant predetermined limited resolution;

means for attenuating the throttle position command signal;

a variable gain amplifier responsive to the attenuated throttle position command signal for generating a modified throttle position command signal;

means for positioning the throttle valve member to an angular position in accord with the value of the modified throttle position command signal; and means for (A) setting the gain of the amplifier to a first value when the attenuated throttle position command signal is less than a predetermined value to provide a first portion of the modified position command signal having a first resolution greater than the predetermined limited resolution, the first portion of the modified position command signal resulting in a desired resolution in the positioning of the throttle valve member at throttle positions less than a position corresponding to the predetermined value of the attenuated throttle portion command signal and (B) setting the gain of the amplifier to a second value greater than the first value when the attenuated throttle position command signal is greater than the predetermined value to provide a second portion of the modified position command signal having a second resolution, the second resolution having a value so that the first and second portions of the modified position command signal provide for the positioning of the throttle valve over the entire predetermined range.

* * * * *